US007432428B2

(12) United States Patent
Kunisada et al.

(10) Patent No.: US 7,432,428 B2
(45) Date of Patent: Oct. 7, 2008

(54) ELECTRONIC KEYBOARD MUSICAL INSTRUMENT

(75) Inventors: Kei Kunisada, Hamamatsu (JP); Takashi Kato, Hamamatsu (JP); Takashi Fujita, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/488,565

(22) Filed: Jul. 18, 2006

(65) Prior Publication Data

US 2007/0017353 A1 Jan. 25, 2007

(30) Foreign Application Priority Data

Jul. 19, 2005 (JP) ..... 2005-208767

(51) Int. Cl.
*G10H 1/00* (2006.01)

(52) U.S. Cl. ..... 84/13; 84/723; 84/742

(58) Field of Classification Search ..... 84/13, 84/19, 723, 735, 742, 746
See application file for complete search history.

(56) References Cited

U.S. PATENT DOCUMENTS

| | | | | |
|---|---|---|---|---|
| 3,449,531 | A * | 6/1969 | Ashworth | 381/152 |
| 3,509,282 | A * | 4/1970 | Ashworth | 381/152 |
| 5,189,242 | A | 2/1993 | Usa | |
| 5,537,908 | A * | 7/1996 | Rabe et al. | 84/454 |
| 5,981,861 | A * | 11/1999 | Van Delinder et al. | 84/743 |
| 6,351,542 | B2 * | 2/2002 | Azima et al. | 381/345 |
| 6,399,870 | B1 * | 6/2002 | Azima et al. | 84/744 |
| 6,846,980 | B2 * | 1/2005 | Okulov | 84/646 |
| 7,002,070 | B2 * | 2/2006 | Katz | 84/718 |
| 2002/0148346 | A1 * | 10/2002 | Okulov | 84/613 |
| 2003/0015086 | A1 * | 1/2003 | Katz | 84/644 |
| 2005/0145100 | A1 | 7/2005 | Ramstein | |
| 2007/0028755 | A1 * | 2/2007 | Suzuki | 84/746 |

FOREIGN PATENT DOCUMENTS

| | | | |
|---|---|---|---|
| JP | 05-073038 | A | 3/1993 |
| JP | 05-080748 | A | 4/1993 |
| JP | 5-80750 | A | 4/1993 |
| JP | 06-259670 | A | 9/1994 |

(Continued)

OTHER PUBLICATIONS

Extended European search report (application No. 06118375.2-2218) issued in related co-pending U.S. Appl. No. 11/499,146.

*Primary Examiner*—David S. Warren
(74) *Attorney, Agent, or Firm*—Rossi, Kimms & McDowell, LLP.

(57) ABSTRACT

An electronic keyboard musical instrument capable of performing delicate sound board vibration control based on outputs generated individually for respective ones of transducers, thereby realizing production of natural sounds with sufficient volume, and an easy tone quality adjustment. A sound board is fixed to a frame, and the transducers are mounted to the sound board so as to be spaced from one another. In accordance with first and second performance signals generated in response to a key operation of a keyboard and a damper pedal operation, driving signals for the transducers are individually generated in consideration of characteristics and mounting positions of the transducers, and the driving signals are supplied to the transducers. The sound board is thereby caused to vibrate at a frequency varying according to a tone pitch, thus producing a musical tone and/or a damper tone.

13 Claims, 9 Drawing Sheets

FOREIGN PATENT DOCUMENTS

| | | | |
|---|---|---|---|
| JP | 7-92967 | A | 4/1995 |
| JP | 2782949 | B2 | 5/1998 |
| JP | 2917609 | B2 | 4/1999 |
| JP | 2001-5458 | A | 1/2001 |
| JP | 2001-272981 | A | 10/2001 |
| JP | 2003-208182 | A | 7/2003 |
| JP | 2004-294832 | A | 10/2004 |

* cited by examiner

ELECTRONIC KEYBOARD MUSICAL INSTRUMENT

BACKGROUND OF THE INVENTION

1. Field of the Invention

The present invention relates to an electronic keyboard musical instrument having a sound board that is caused to vibrate to generate musical tones.

2. Description of the Related Art

Electronic keyboard musical instruments have been improved so as to be capable of faithfully reproducing natural musical tones of a spreading feeling produced by acoustic musical instruments. However, there are still some differences in sound between electronic keyboard musical instruments and acoustic musical instruments.

Specifically, an acoustic musical instrument produces not only musical tones sounded by vibrations of vibrating members such as strings, but also sounds generated by musical instrument components that are made in contact with one another when an operator such as a key is driven. The resonance of a sound board and other component of the-musical instrument can also produce sounds. Moreover, the aforementioned various sounds complicatedly interact with one another to produce further sounds. On the other hand, such complicated sounds cannot fully be expressed by existing electronic keyboard musical instruments.

For example, there is known an electronic keyboard musical instrument in which a tone is generated according to a performance operation of the instrument, and the generated tone is sounded as a performance tone from a speaker. However, musical tones are sometimes sounded by an acoustic musical instrument in a complicated environment in which tones are affected by operative states and operating timings of a keyboard and a pedal of the musical instrument, whereas the known electronic keyboard musical instrument entails a limitation in the reproduction of tones sounded in such a complicated environment. This results in insufficient expression.

Furthermore, another type of electronic keyboard musical instrument has been known in which transducers (vibrating devices) are mounted to a sound board of this musical instrument to cause the sound board to vibrate to thereby output complicated resonance sounds (Japanese Patent Publication No. 2917609 and Japanese Laid-Open Patent Publication (Kokai) No. H05-80748).

However, electronic keyboard musical instruments using transducers as disclosed in the aforementioned Japanese Patent Publications have still been under development, and require further improvements in respect of the required number of transducers and characteristics and installation arrangement of the transducers in order to permit musical tones to be sounded with sufficient volume and freely perform tone quality control.

SUMMARY OF THE INVENTION

An object of the present invention is to provide an electronic keyboard musical instrument capable of performing delicate sound board vibration control based on outputs generated on a vibrating device-by-vibrating device basis, thereby realizing production of natural sounds with sufficient volume, and an easy tone quality adjustment.

In order to attain the object, according to the present invention, there is provided an electronic keyboard musical instrument in which a sound board made of a plate-like member is caused to vibrate to generate a musical tone. The electronic keyboard musical instrument comprises a plurality of performance operators, a plurality of vibrating devices that are each driven by a driving signal to cause the sound board to vibrate, the vibrating devices being mounted to the sound board and spaced from one another and having different characteristics from one another, and a signal generating and outputting device that generates driving signals for respective ones of the vibrating devices in response to at least any one of the performance operators being operated and outputs the generated driving signals.

According to the present invention, delicate sound board vibration control can be carried out based on outputs of the signal generating and outputting device that are generated on a vibrating device-by-vibrating device basis, thereby realizing production of natural sounds with sufficient volume and an easy tone quality adjustment.

Preferably, the vibrating devices are mounted to the sound board at positions determined according to their characteristics, and the signal generating and outputting device generates the driving signals in accordance with the characteristics and the arranged positions of the vibrating devices, and outputs the generated driving signals.

According to the preferred form of the present invention, output distribution of the driving signals are made appropriate, thus making it possible to realize the production of natural sounds with ample volume.

Preferably, the plurality of performance operators include a keyboard having a plurality of keys and at least one damper pedal, and the signal generating and outputting device includes a first performance signal generator that generates a first performance signal in response to a key operation of the keyboard, and a second performance signal generator that generates a second performance signal in response to an operation of the damper pedal.

More preferably, the signal generating and outputting device includes a first processing section in which the first performance signal is subjected to first processing, a second processing section in which the second performance signal is subjected to second processing, and an output distributing section that distributes outputs to the vibrating devices based on a mixture signal of the first performance signal having been subjected to the first processing and the second performance signal having been subjected to the second processing.

More preferably, the first performance signal is subjected to effect processing in the first processing section, the second performance signal is subjected to delay processing in the second processing section, and the output distributing section distributes the outputs to the vibrating devices based on an addition signal of the first performance signal having been subjected to the effect processing and the second performance signal having been subjected to the delay processing.

Preferably, the signal generating and outputting device includes a first performance data storage that stores first performance data indicating musical tones sounded by an acoustic piano when a piano key is operated without a piano damper pedal being depressed, and a second performance data storage that stores second performance data indicating musical tones sounded by the acoustic piano when a piano key is operated with the piano damper pedal being depressed, and the first performance signal generator generates the first performance signal using the first performance data, and the second performance signal generator generates the second performance signal using the second performance data.

Preferably, the electronic keyboard musical instrument includes at least one leg member, and a frame mounted to the leg member, the damper pedal is mounted to the leg member, the sound board and the keyboard are supported by the frame, and the sound board is formed into a shape of a piano sound board.

More preferably, the frame is smaller in size than and similar in shape to the sound board.

Preferably, the sound board is fixed to the frame using a plurality of fixtures.

Preferably, the electronic keyboard musical instrument includes at least one leg member and a frame fixed to the leg member, and the sound board is fixed to the frame using a plurality of fixtures.

Preferably, the vibrating devices include a first vibrating device mounted to a lower tone side of the sound board and serving to generate a lower tone, and a second vibrating device mounted to a higher tone side of the sound board and serving to generate a higher tone.

Preferably, the vibrating devices are mounted to the sound board at locations where node lines produced when the sound board is caused to vibrate with natural frequencies thereof are less dense.

Preferably, the vibrating devices are mounted to the sound board at locations avoiding the fixtures and the frame.

More preferably, the vibrating devices are mounted to the sound board at locations avoiding specific positions that are at a distance equal to a quotient of a distance between each pair of the fixtures divided by integer number.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail below with reference to the drawings showing preferred embodiments thereof.

Figure 1:
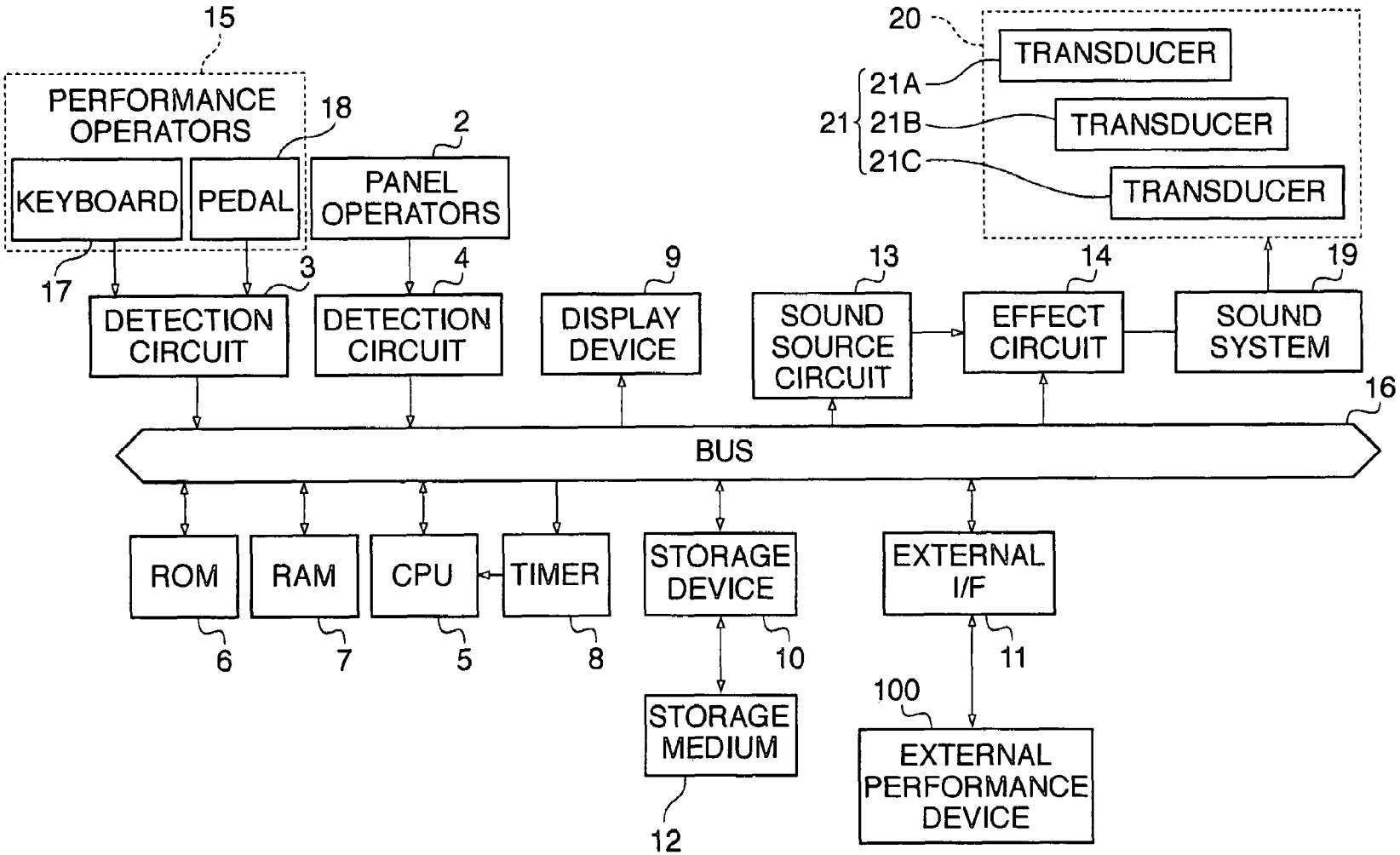
FIG. 1 is a block diagram showing the overall arrangement of an electronic keyboard musical instrument according to an embodiment of the present, invention.
Figure 2:
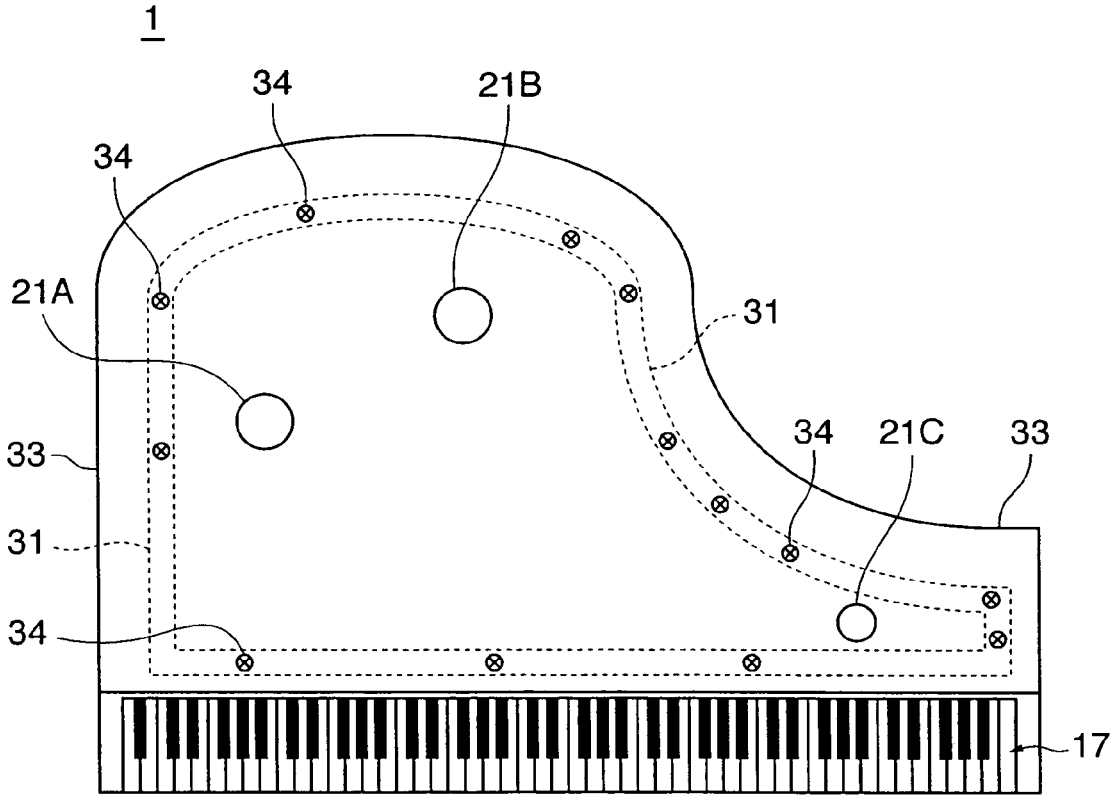
FIG. 2 is a plan view of the electronic keyboard musical instrument.
Figure 3A:
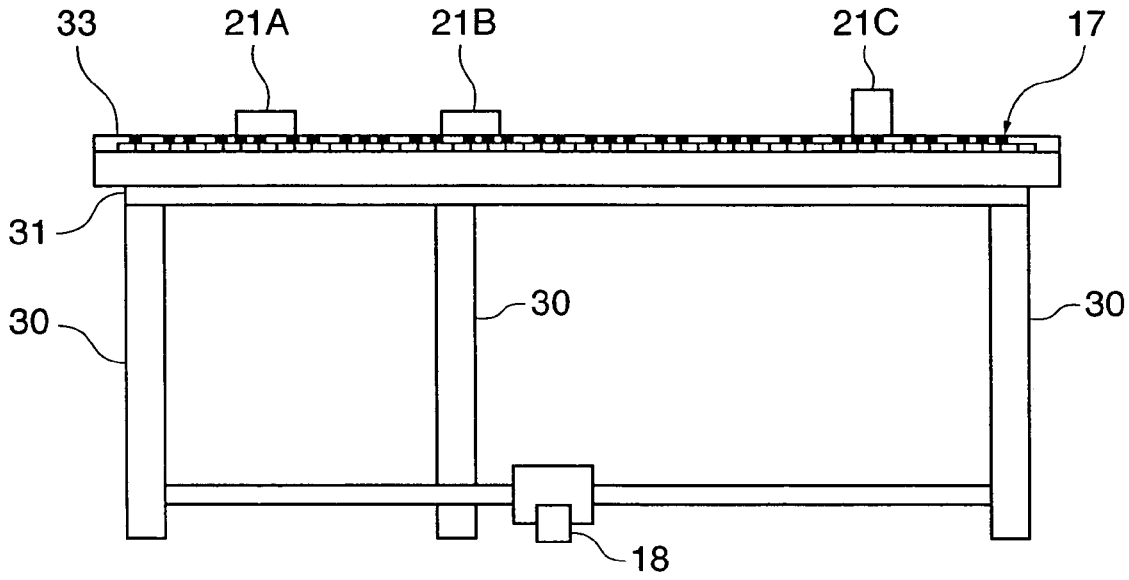
FIG. 3A is a front view of the electronic keyboard musical instrument.
Figure 3B:
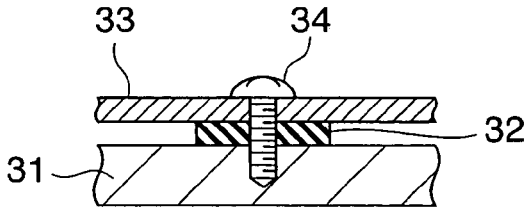
FIG. 3B is a fragmentary section view showing a mounting portion of a sound board to a frame in the electronic keyboard musical instrument.

FIG. 1 is a block diagram showing the overall arrangement of an electronic keyboard musical instrument according to an embodiment of the present invention. FIG. 2 is a plan view of the electronic keyboard musical instrument. FIG. 3A is a front view of the electronic keyboard musical instrument. FIG. 3B is a fragmentary section view showing a mounting portion a sound board to a frame.

As shown in FIG. 1, the electronic keyboard musical instrument is comprised of a first detection circuit 3, a second detection circuit 4, a ROM 6, a RAM 7, a timer 8, a display device 9, a storage device 10, and an external interface (external I/F) 11, a sound source circuit 13, and an effect circuit 14, which are connected via a bus 16 to a CPU 5.

Performance operators 15 are connected to the detection circuit 3 and include a keyboard 17 having a plurality of keys for inputting pitch information. A damper pedal (hereinafter referred to as "the pedal") is operated for performance by foot. Panel operators 2 include a plurality of switches for inputting various information, and are connected to the detection circuit 4. The display device 9 is comprised of a liquid display device (LCD) or the like for displaying various information such as musical scores and characters. The timer 8 is connected to the CPU 5. An external performance device is connected to the external I/F 11. Further, a sound generating section 20 is connected to the effect circuit 14 through a sound system 19 that includes a DAC (Digital-to-Analog Converter), an amplifier, and the like.

The first detection circuit 3 detects operative states of the performance operators 15, whereas the second detection circuit 4 detects operative states of the panel operators 2. The CPU 5 controls the entire electronic keyboard musical instrument. The ROM 6 stores control programs executed by the CPU 5, various table data, etc. The RAM 7 temporarily stores various input information such as performance data, text data, flags, buffer data, and computation results. The timer 8 measures interrupt time in a timer interrupt process and various kinds of time. The storage device 10 stores application programs including the control programs, various musical composition data, and various other data.

The external I/F 11 includes a MIDI I/F and communication I/Fs, inputs MIDI (Musical Instrument Digital Interface) signals from external devices such as the external performance device 100, and outputs MIDI signals to the external devices, for instance. The sound source circuit 13 converts performance data input from the performance operators 15 and preset performance data into musical tone signals. The effect circuit 14 applies various effects to musical tone signals input from the sound source circuit 13.

The storage device 10 comprises a hard disk drive (HDD), for instance. The storage device 10 can read and write data from and into an external storage medium 12 such as a flexible disk drive (FDD), a CD-ROM drive, and an optomagnetic disk (MO) drive.

The sound generating section 20 includes a plurality of (e.g., three) transducers 21 (transducers 21A, 21B, and 21C). The sound generating section 20 applies vibrations to the sound board shown in FIG. 2 in accordance with performance data and an operation of the performance operators 15. In other words, the electronic keyboard musical instrument has no speakers and hence generates sounds solely by vibrating the sound board 33.

As shown in FIG. 3A, the pedal 18 is mounted to a lower front portion of the leg member 30 whose upper portion is fixed to the frame 31. As show in FIG. 2, the keyboard 17 is disposed close to the player side (front side) of the electronic keyboard musical instrument, as in a grand piano. The sound board 33 is disposed behind the keyboard 17. As shown in FIG. 2, the sound board 33 is formed into a shape similar to that of a sound board of a grand piano. The sound board 33 is made of a wood plate of about 1 cm thickness, and uniform in thickness. The sound board 33 has its depth that is smaller in length on the higher tone side (the right side in FIG. 2) than on the lower tone side (the left side in FIG. 2). The sound board 33 is not limited in material from which it is made insofar as it is suitable for sound production, and the thickness thereof can also be freely determined as required.

As viewed in plan, the frame is formed into a frame-shape generally following the periphery of the sound board 33. Specifically, the outer dimension of the frame 31 is slightly smaller than that of the sound board 33 and similar in shape to the sound board 33. As shown in FIGS. 2 and 3B, the sound board 33 is fixed to and held by an upper face of the frame 31, through rubber plate members 32 by means of a plurality of screws 34 (more generally, fixtures) that are spaced from one another.

The transducers 21A, 21B, and 21C are arranged on the upper face of the sound board 33 and spaced from one another. The transducer 21A is disposed on a lower tone side of the sound board 33, and the transducer 21B is disposed in a mid tone range of the sound board 33. The transducer 2C is disposed on a higher tone side of the sound board 33 in which the depth dimension is small. As for the positional relation in the depth direction, the transducer 21C is positioned on the front most side of the electronic keyboard musical instrument, and the transducer 21B is disposed at the rearmost side thereof. The positions where the transducers 21A, 21B, and 21C are disposed are determined so that the sound board 33 can efficiently vibrate, as described in detail below.

The transducers 21 are directly attached to the sound board 33. The way of attaching the transducers is not limitative. By way of example, screwing, adhesion, or any other method may be adopted. The transducers 21 have a known construction as described in FIG. 1 or 2 on page 266 of "Radio Technology" published in Japan on March of 1971. Specifically, the transducer vibrates upon application of an electric signal (a performance signal or a driving signal), and the sound board 33 is caused to vibrate by a reaction force generated due to the transducer's own weight. The construction of the transducers 21 is not limited thereto but may be one so far as the transducers can cause the sound board 33 to vibrate to generate sounds.

The transducers 21A and 21B employed in the present embodiment are the same in construction. The transducers 21A and 21B are large in size so as to be able to respond to lower frequencies. They have excellent vibration efficiency especially at frequencies around 250 Hz and can generate strong vibration. Thus, they mainly serve to generate sounds in a lower tone range. At frequencies higher than about 250 Hz, vibrations generated are small in strength.

The transducer 21C differs in characteristic from the transducers 21A and 21B. More specifically, the transducer 21C differs therefrom in vibration efficiency in relation to input signals supplied thereto. The transducer 21C is smaller in size than the transducers 21A and 21B, and responds to higher frequencies as than those to which the transducers 21A and 21B respond. The transducer 21C can efficiently apply vibration at a frequency of 1000 Hz or higher. Vibrations that can be generated by the transducer 21C are not as strong as those generated by the transducers 21A and 21B. The transducer 21C mainly serves to generate sounds in a higher tone range.

Figure 4:
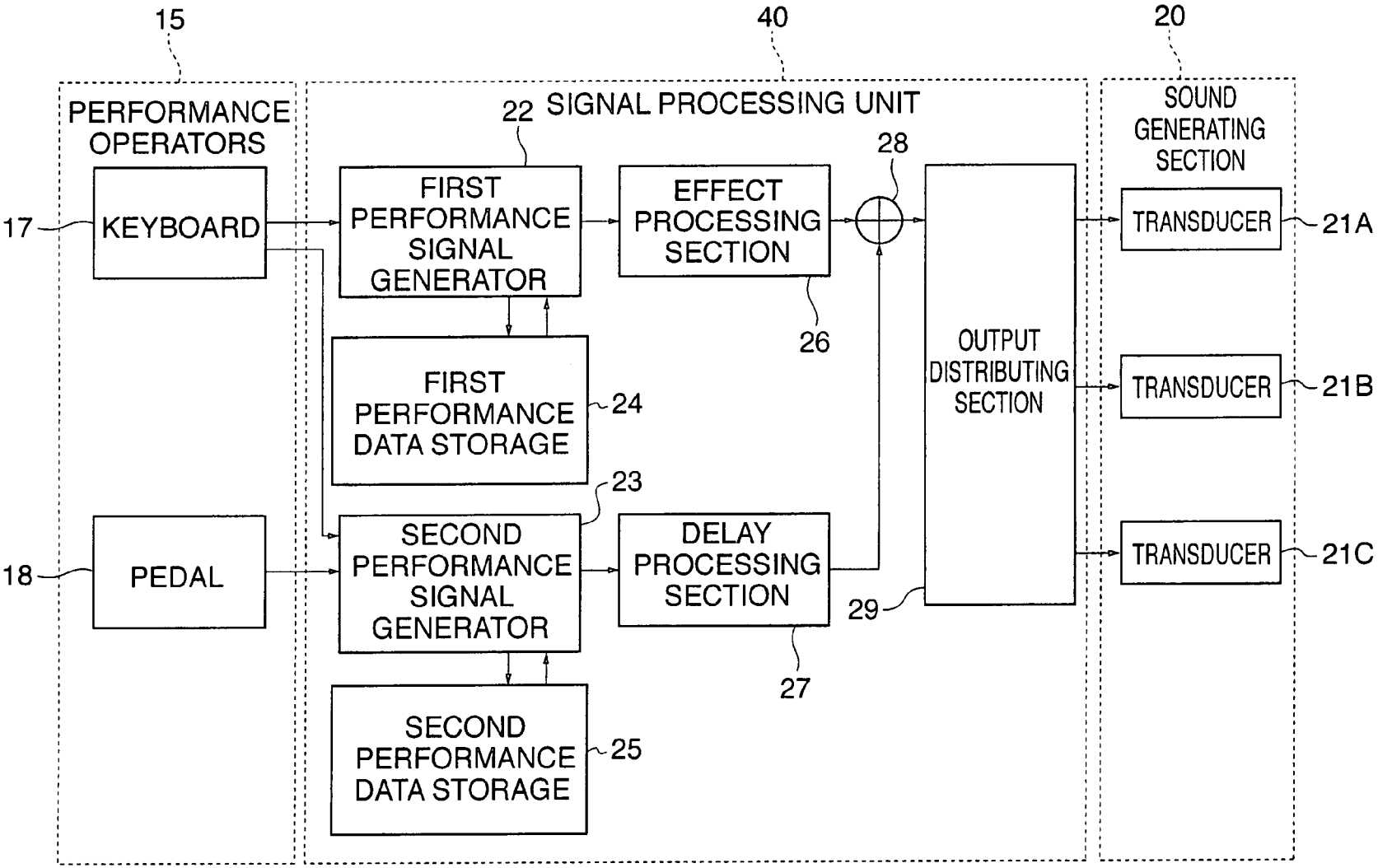
FIG. 4 is a block diagram showing functions of the electronic keyboard musical instrument.

FIG. 4 is a block diagram showing the functions of the electronic keyboard musical instrument. A signal processing unit 40 shown in FIG. 4 includes various functional components, i.e., first and second performance signal generators 22, 23; first and second performance data storages 24, 25; an effect processing section 26; a delay processing section 27; an adder 28; and an output distributing section 29. The functions of these functional components of the signal processing unit 40 are realized by cooperation of components such as the CPU 5, the ROM 6, the RAM 7, the timer 8, the storage device 10, the external interface 11, the sound source circuit 13, the effect circuit 14, and the sound system 19 that are shown in FIG. 1.

The first performance data storage 24 stores, as first performance data, wave data (first performance data) that are obtained by sampling, on a pitch-by-pitch basis, respective ones of musical tones each generated when a corresponding piano key of an acoustic grand piano is operated without a piano damper pedal being depressed. On the other hand, the second performance data storage 25 stores, as second performance data, wave data that obtained by subtracting wave data equivalent to the first performance data from wave data that are obtained by sampling, on a pitch-by-pitch basis, respective ones of musical tones each generated when a corresponding piano key is operated with the piano damper pedal being depressed. In other words, the first performance data are intended to be used for reproduction of ordinary tones produced in acoustic piano performance. The second performance data are intended to be used for reproduction of damper tones of a spreading feeling presented by the resonance of strings other than struck strings in acoustic piano performance with a piano damper pedal depressed. The first and second performance data are stored in the ROM 6, for example, serving as the first and second performance data storages 24 and 25.

response to a depressing/releasing operation of any of the keys of the keyboard 17, the first performance signal generator 22 generates a first performance signal using the first performance data concerned, and then delivers the generated first performance signal to the effect processor 26. On the other hand, in response to operations of the pedal 18 and the keyboard 17, the second performance signal generator 23 generates a second performance signal using the second performance data concerned, and sends the generated signal to the delay processor 27. The first performance signal sent to the effect processor 26 is subjected to the effect processing preset therein, whereas the second performance signal sent to the delay processor 27 is subjected to predetermined delay processing in the delay processor 27. The thus processed first and second performance signals are added and mixed together in the adder 28, and are then sent to the output distributing section 29.

In response to the supply of the mixed signal, the output distributing section 29 distributes outputs to the transducers 21. Specifically, the output distributing section 29 generates analogue driving signals for the transducers 21A, 21B, and 21C, amplifies the generated signals, and outputs the resultant signals to the transducers. More concretely, the output distributing section 29 generates and outputs analogue driving signals that cause the sound board 33 to vibrate at frequencies corresponding to tone pitches represented by the mixed signal with strengths corresponding to velocities also represented by the mixed signal. At this time, in order to adjust output balance between the three transducers 21, the output level of the transducer 21C is made higher for high-pitched mixed signals, whereas the output levels of the transducers 21A and 21B are made higher for low- and middle-pitched mixed signals, so that the sound field localization is made coincide with the operated key as close as possible.

The output balance of the driving signals produced according to the first and second performance signals generated when any of the keys is operated is the same between the transducers 21. Alternatively, the driving signal output balance may vary between the transducers 21.

Figure 5A:
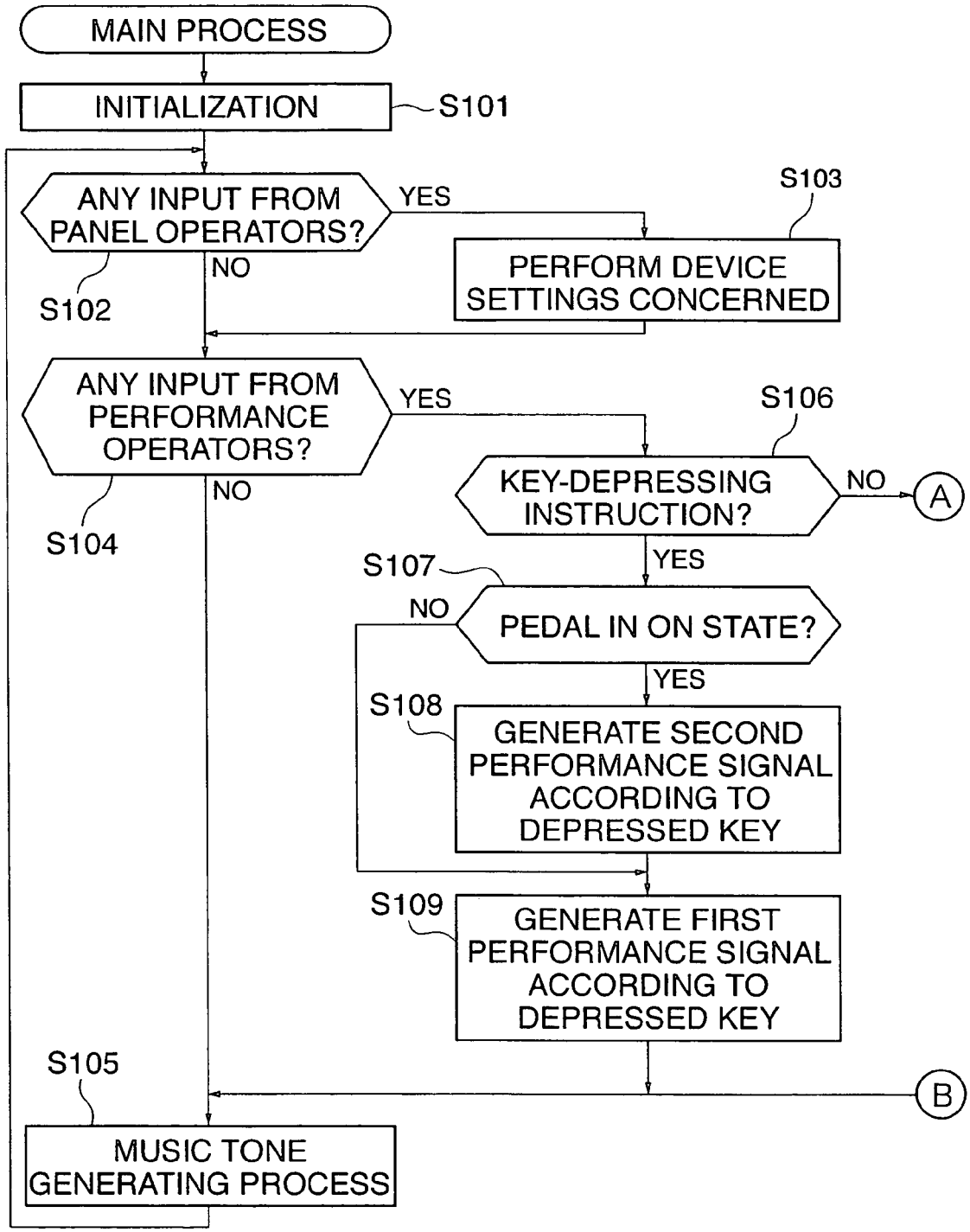
FIG. 5A is part of a flowchart of a main process.
Figure 5B:
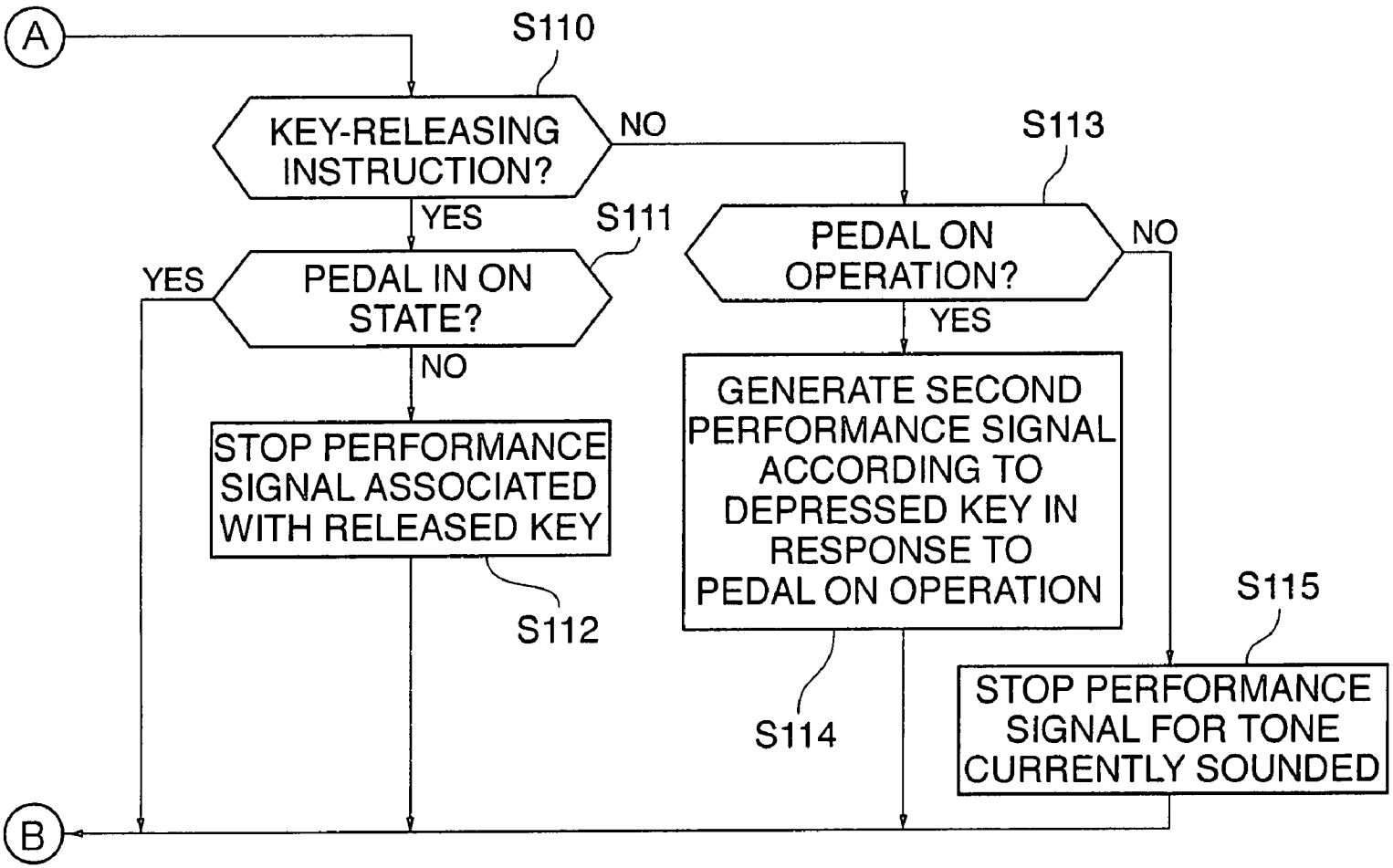
FIG. 5B is the remaining part of the flowchart of the main process.
Figure 6A:
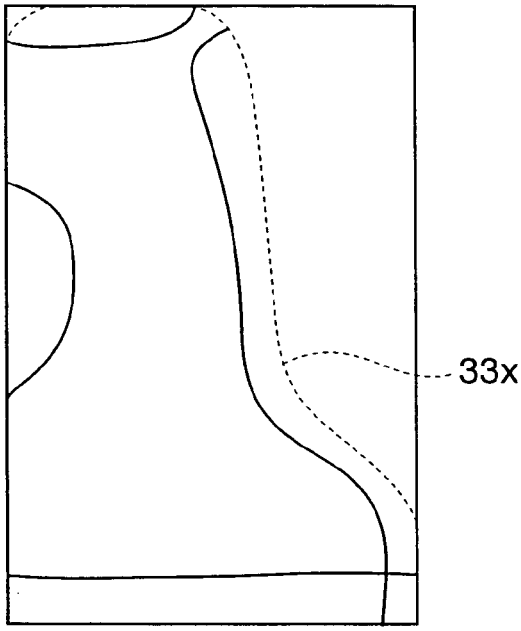
FIG. 6A is a diagram showing node lines generated when a sound board is caused to vibrate at its natural frequency of 50 Hz.
Figure 6C:
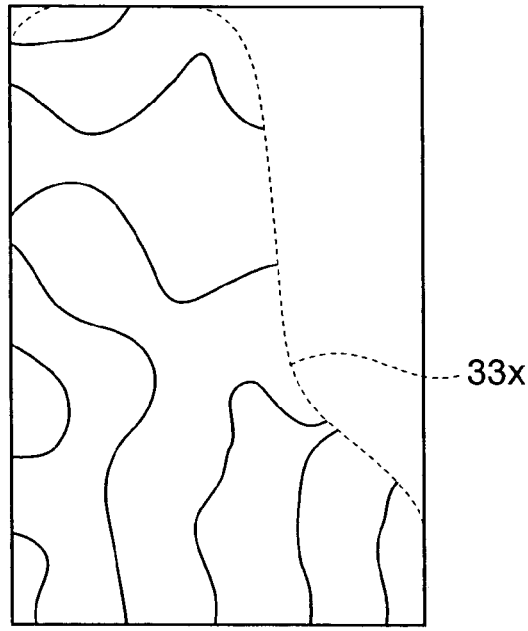
FIG. 6C is a diagram showing node lines generated when the sound board is caused to vibrate at its natural frequency of 260 Hz.
Figure 6B:
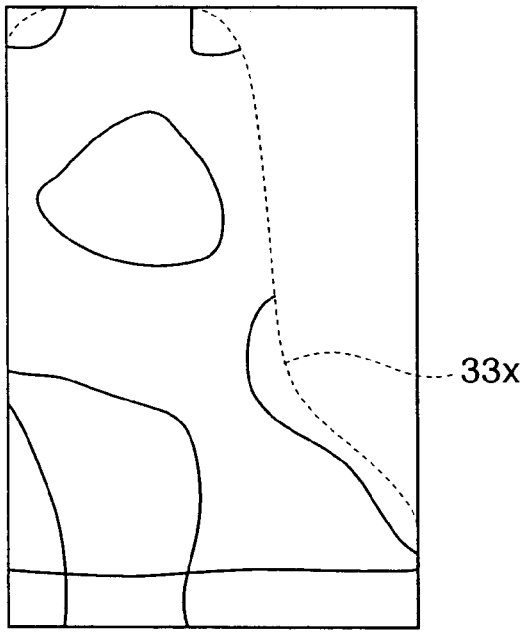
FIG. 6B is a diagram showing node lines generated when the sound board is caused to vibrate at its natural frequency of 140 Hz.
Figure 6D:
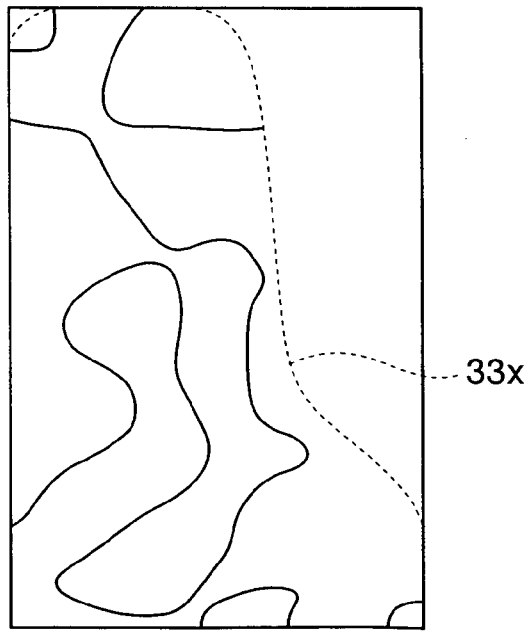
FIG. 6D is a diagram showing node lines generated when the sound board is caused to vibrate at its natural frequency of 360 Hz.

FIG. 5 is a flowchart of a main process that is started when power supply is turned on.

Initialization is first carried out. Specifically, a predetermined program is started to be executed in order to set registers of the RAM 7, etc. to their initial values, thereby completing initial settings (step S101). Next, whether or not there is an input from any of the panel operators 2 is determined (step S102), and in response to the input, there are carried out device settings concerned, such as tone volume settings, tone color settings, and effect settings (step S103). Subsequently, whether or not there is an input from any of the performance operators 15 is determined (step S104). If it is determined that there is no input, the flow proceeds to a step S105. On the other hand, if there is any input, whether or not the input indicates a key-depressing instruction (depression of any of the keys of the keyboard 17) is determined (step S106).

If the result of the determination indicates that the instruction does not represent a key-depressing instruction, then whether or not the input represents a key-releasing instruction is determined (step S110). If it is determined that the input does not represent a key-releasing instruction, a further determination is made as to whether or not the input indicates an ON operation of the pedal 18 (step S113). If the input does not indicate an ON operation of the pedal 18, the flow proceeds to a step S115, determining that the input indicates an OFF operation of the pedal 18.

Thus, when the input from any of the performance operators 15 represents a key-depressing instruction, steps S107 to S109 are carried out. When the instruction represents a key-releasing instruction, steps Sill and S112 are carried out. If the input indicates an ON operation of the pedal 18, a step S114 is executed, and on the other hand, if the input indicates an OFF operation of the pedal 18, the step S115 is executed. In each case, the flow then proceeds to the step S105.

In the step S107, whether or not the pedal 18 is currently in an ON state is determined. If the pedal 18 is not in an ON state, the flow proceeds to the step S109 where the first performance data corresponding in tone pitch to the depressed key is read out from the ROM 6. Then, based on the first performance data 24, the first performance signal having an envelope varying according to the velocity of the depressed key is generated. On the other hand, if the pedal 18 is in an ON state, the flow proceeds to the step S108 where the second performance data is read out in accordance with the pitch corresponding to the depressed key, and the second performance signal having an envelope that varies in accordance with the velocity of the depressed key is generated. Whereupon, the step S109 is executed.

In the step S111, whether or not the pedal 18 is currently in an ON state is determined. If the pedal 18 is not in an ON state, the flow proceeds to the step S112 where the performance signal associated with the released key is stopped. Specifically, in order to subject a currently sounded tone to a tone damping process, a tone damping signal is generated. In the tone damping process, the first performance data having an envelope varying according to a key-releasing operation is generated. On the other hand, if the pedal 18 is in an ON state, the flow proceeds to the step S105, without the performance signal being stopped.

In the step S114, when any of the keys is in a depressed state so that there is a currently sounded tone, the second performance signal corresponding to the depressed key is generated in accordance with an ON operation of the pedal 18. Specifically, the second performance data corresponding to the pitch of the key that is in a depressed state is read out, and then the second performance signal is generated whose envelope coincides with a state of attenuation of the sound that is being subjected to sounding processing.

In the step S115, when there is any tone that is currently sounded at a pitch corresponding to a key other than the key which is in a depressed state, a performance signal corresponding to that tone is stopped. Specifically, in order that the currently sounded musical tone is caused to be subjected to tone damping processing, a signal for tone damping is generated. In the tone damping processing, first and second performance data are read out that are associated with the currently sounded tones' pitch not corresponding to the key which is in a depressed state, and first and second performance signals for tone damping are generated that have envelopes varying corresponding to an OFF operation of the pedal 18.

In the step S105, based on the first and second performance signals generated as described above, driving signals are individually generated so as to provide sound localization corresponding to tone pitch while taking account of characteristics and positions of the transducers 21. The generated driving signals are output. As a result, the sound board 33 is caused to vibrate at a frequency corresponding to the tone pitch, to thereby generate a performance tone or generate both the performance tone and a damper tone. Whereupon, the flow returns to the step S102.

As compared to musical tones generated by a speaker, musical tones generated by vibrations of the sound board 33 based on operative states and operating timings of the keyboard 17 and the pedal 18 as described above can more faithfully reproduce musical tone sounded in a complicated. active circumstances in which musical tones are affected by operative states and operating timings of a piano keyboard and a piano pedal. Thus, the resultant musical tones are satisfactory in quality and provide natural sounds. In particular, since the sound board 33 is similar in shape to the sound board of a grand piano, sounds generated by vibrations of the sound board 33 are similar to sounds of a live piano performance. Moreover, as viewed in plan, the frame 31 is formed in a frame-like shape that follows the outer profile of the sound board 33, and accordingly, the sound board 33 can vibrate with large amplitude (at considerably lower frequencies), thus satisfactorily reproducing sounded tones and damper tones in a lower tone range. In addition, the transducers 21 are disposed at locations where the transducers 21 can efficiently cause the sound board 33 to vibrate to thereby make it possible to attain a sufficiently large volume of sounding.

As for sound quality control, sound quality can be changed to some extent by changing driving signals to be supplied to the transducers 21 even for the musical tone sounding at the same pitch and the same volume. Settings of sound quality can be input through the panel operators 2 in the step S102 in FIG. 5.

Next, a description will be given of the way of determining positions where the transducers 21 are to be disposed.

FIGS. 6A through 6D are diagrams showing monitor screens on which node lines observed when the sound board 33 is caused to vibrate at different natural frequencies are each displayed together with an outer profile line 33x corresponding to the outer profile of the sound board 33.

Positions where the transducers 21 are to be disposed are determined in accordance with the following steps (i) to (v).

(i) After fine granular material such as sand is dispersed on the sound board 33, the sound board 33 is caused to freely vibrate while gradually changing the frequency supplied thereto.

(ii) Positions of node lines are determined for respective natural frequencies based on an aggregation state of granular material on the sound board 33, the granular material gathering together onto the node lines when the changing frequency becomes equal to one of the natural frequencies of the sound board 33.

(iii) The node lines determined at the respective natural frequencies are superposed one upon another on a plane corresponding to the sound board 33.

(iv) Places on the plane where the superposed node lines are less dense are determined.

(v) The places where the node lines are less dense are determined as positions where the transducers 21 are to be disposed.

In the step (i), the frequency applied to the sound board 33 is gradually changed stepwise in a range, e.g., from about 50 Hz to 400 Hz, thereby causing the sound board 33 to vibrate. On this occasion, the construction and fixed state of the sound board 33 are kept unchanged, so that conditions other than the frequency applied to the sound board do not vary. In the steps (i) to (iii), node lines are determined by visual inspection or other detection measures while actually causing the sound board 33 to vibrate, as described above. In the present embodiment, however, the steps (i) to (iii) are realized by computer analysis instead of by actually vibrating the sound board 33.

For the step (i) performed by computer analysis, the size, shape, thickness, kind of material, material density, Young's modulus, and Poisson's ratio of the sound board 33 as well as mounting positions of screws 34 and the like are input in advance. Next, in the step (ii), the outer profile line 33x and the node lines determined by computer analysis at respective ones of the given natural frequencies are displayed on a computer monitor screen serving as the aforementioned plane corresponding to the soundboard 33. In FIGS. 6A through 6D, the displayed screens are partly shown by way of example, where the natural frequencies of vibration are 50 Hz, 140 Hz, 260 Hz, and 360 Hz, for instance.

Figure 7:
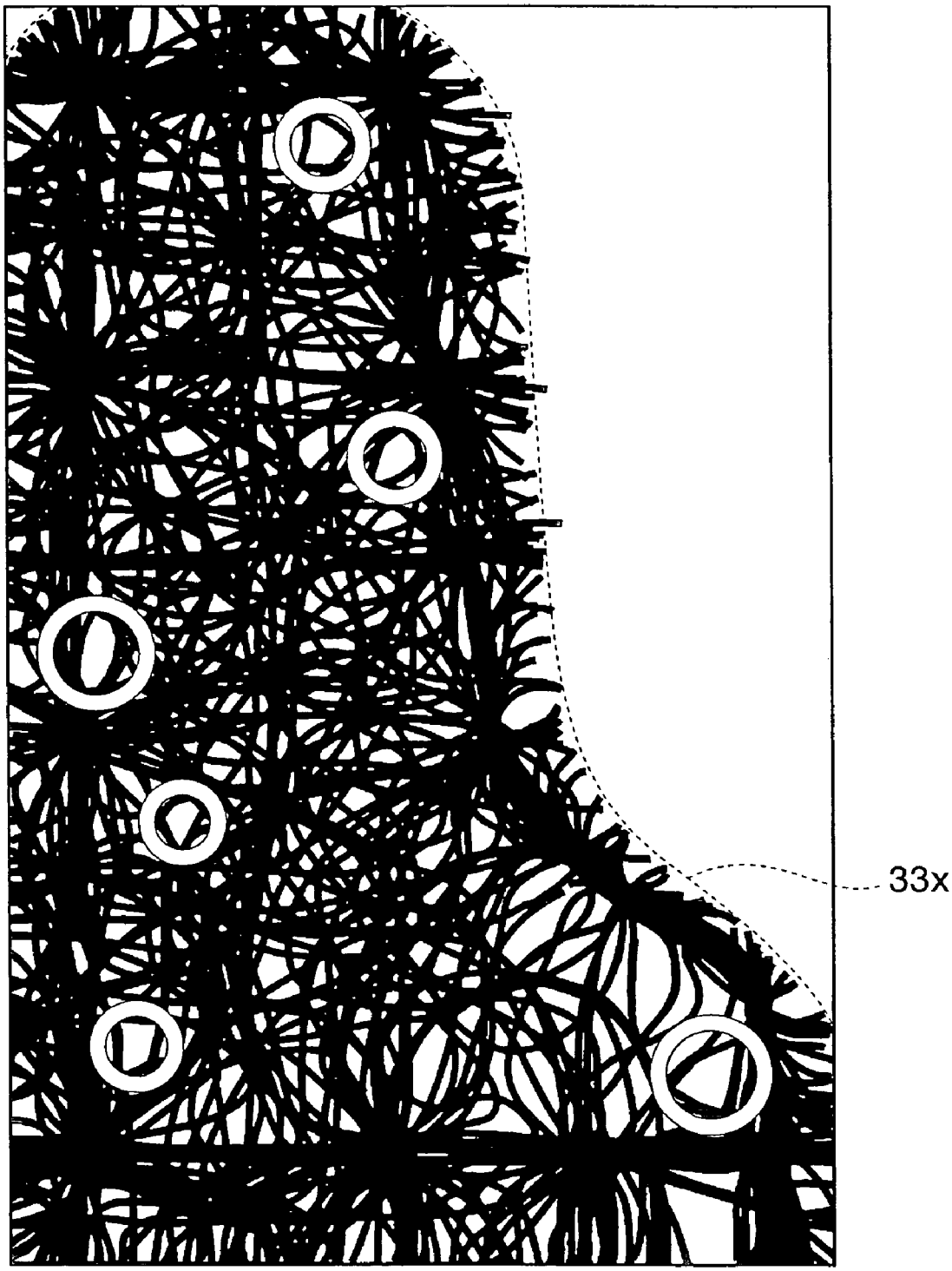
FIG. 7 is a diagram showing a monitor screen on which node lines generated by causing the sound board to vibrate at various natural frequencies are displayed one upon another.

In the step (iii), the node lines at the respective natural frequencies that are superposed one upon another are displayed on the computer monitor screen, as shown in FIG. 7. In the step (iv), the superposed node lines shown in FIG. 7 are visually inspected to find less dense portions where the node lines are less dense and dense portions where they are dense, and then the less dense portions are identified (as shown by white double circles in FIG. 7). In the next step (v), those positions on the sound board 33 which correspond to the positions of the less dense portions on the monitor screen are identified, and the identified less dense positions on the sound board 33 are determined as candidates for positions where the transducers 21 are to be disposed. It is considered here that the determined candidates for transducer installation positions are considerably greater than three in number. Thus, thereafter, the sound board 33 is caused to actually vibrate, with the transducers 21 disposed at temporarily selected ones among the candidates for transducer installation positions. Such is repeated while changing the temporary transducer installation positions, to find an optimum combination of the transducer installation positions.

In determining the installation positions of the transducers 21, there are several points to be considered. Each of the transducers 21 must be positioned at a location matching its characteristics. Specifically, large-sized transducers such as the transducer 21A for lower tones are preferably disposed at positions in the left half of the sound board 33, whereas small-sized transducers such as the transducer 21C for higher tones are preferably disposed at positions in the right half of the soundboard 33. In order to properly control the sound field localization, at least two of the transducers 21 must be separated from each other in the right and left direction of the sound board 33.

As for transducer installation positions in the depth direction of the sound board 33, transducers for mid/lower tones must not be disposed at locations near the front side of the sound board 33. Specifically, the transducers for mid/lower tones vibrate with large amplitude, and such large-amplitude vibration can produce an itch, a feeling of discomfort to the user when it is conveyed to a user, i.e., a player. On the other hand, such discomfort is less likely to occur by vibration from transducers for higher tones. From the viewpoint of attaining a clear sound localization, it is preferable that the transducers for higher tones be disposed near the player. In short, among the plurality of the transducers 21, the front most one is preferably disposed on the highest tone side (right side of the sound board 33.

The way of arranging the transducers 21 shown in FIG. 2 is determined in consideration of the above-described points. As viewed in plan, the installation positions of the transducers 21 are determined to bypass the frame 31 and the screws 34. To cause the sound board 33 to vibrate at or near the same frequency as any of the natural frequencies thereof, it is inefficient to excite vibration of the sound board 33 at positions that are on or near node lines which appear when the sound board 33 is caused to vibrate at any of the natural frequencies. Less dense positions where node lines are less dense that have been determined by causing the sound board 33 to vibrate at a variety of frequencies represent positions where relatively efficient vibration can be caused irrespective of frequency applied to the sound board. In this example, such positions are selected for installation of the transducers 21.

Instead of the computer analysis, a geometrical identification technique may be used in which the mounting positions of the screws 34 and the frame 31 are mainly considered for simplification in identifying the less dense portions where the node lines appearing on the sound board 33 are less dense.

Figure 8A:
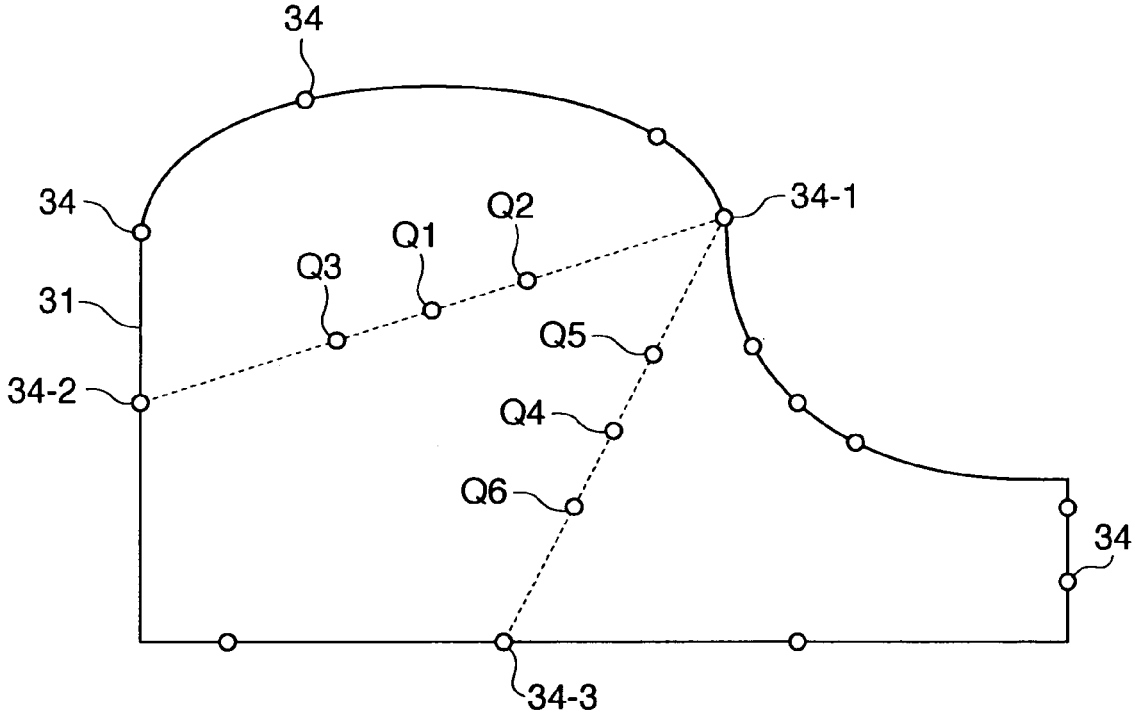
FIG. 8A is a diagram showing screw mounting positions and points passed by node lines.
Figure 8B:
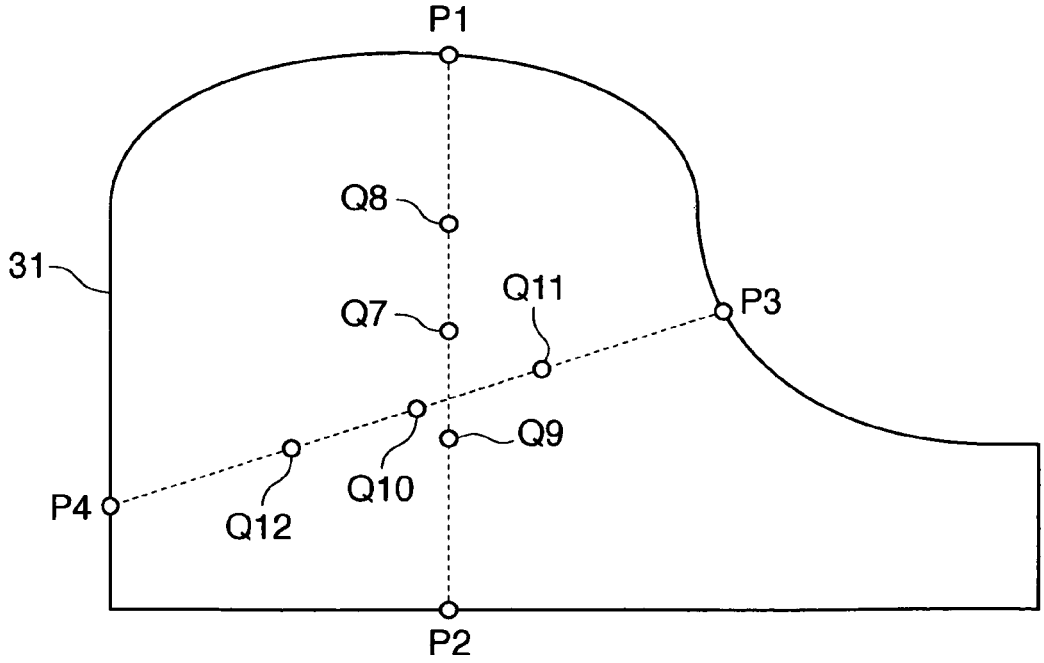
FIG. 8B is a diagram showing positions on a frame and points passed by node lines.

FIG. 8A is a schematic view showing mounting positions of the screws 34 and specific points through which node lines pass, and FIG. 8B is a schematic view showing mounting positions on the frame 31 and specific points passed by node lines.

In an example shown in FIG. 8A, specific points Q1, Q2, and Q3 are first determined. The point Q1 is the midpoint between a first screw 34-1 and a second screw 34-2. The point Q2 is located at a distance of one-third of the distance between the screws 34-1 and 34-2 from the screw 34-1. The point Q3 is located at a distance of two-third of the distance therebetween from the screw 34-1. These points Q1, Q2 and Q3 are at positions each obtained by dividing the distance between the screws 34-1 and 34-2 by an integer number of 2 or 3.

Similarly, points Q4, Q5 and Q6 are determined between the first screw 34-1 and a third screw 34-3. It should be noted that points between each pair of other screws, which are similar to the points Q1, Q2 and Q3, are also determined. Processing for the determination of points can be performed by computer processing.

At locations on the sound board 33 along which node lines will appear upon vibrational excitation of the sound board, the sound board 33 hardly vibrates in the vertical direction. In other words, even if an attempt is made to cause the sound board 33 to vibrate by supplying an exciting input to such locations on the sound board, it is impossible to efficiently vibrate the sound board 33. Without regard to the locations on the sound board 33 to which an exciting input is supplied for vibrational excitation and the frequency of the exciting input, each of the resultant node lines passes through at least corresponding one of the mounting positions of the screws 34. Furthermore, it is considered that node lines appearing upon vibrational excitation at a given frequency are likely to pass through the points Q each located at a distance equal to a quotient of a distance between each pair of the screws 34 divided by an integer number. Thus, considering that the node line density is low at specific positions on the sound board 33 bypassing the points Q and the screws 34, such specific positions are determined as candidates for installation positions of the transducers 21. It should be noted that node lines are likely to pass through various positions in the frame 31 for the reason that a number of screws 34 are screwed into the frame 31 to fix the sound board 33 to the frame 31 and hence there are a large number of specific points Q between adjacent ones of the screws 34.

FIG. 8B shows an example where the frame 31 is in close contact at the entirety of its upper end face with the sound board 33, i.e., where a rubber member 32 (refer to FIG. 3B) is provided on the entire upper end face of the frame 31. In such a case, as in the example shown in FIG. 8A, specific points Q (e.g., Q7, Q8, Q9) on the frame 31 are determined that are located at a distance equal to a quotient of a distance between arbitrary two points P (e.g., P1, P2) divided by an integer number, where the point P1 is an arbitrary point on the frame 31, and the point P2 is a point disposed on the frame 31 to face the point P1. The points P1 and P2 are selected, for example, such that a line connecting them divides the entire area defined inside the frame 31 into two. Similarly, points Q (Q10, Q11, Q12) are determined between a further arbitrary point P3 and a point P4 facing thereto. In this manner, specific points Q are determined between arbitrary points on the frame that are as large in number as possible and points each facing a corresponding one of the arbitrary points. Then, positions bypassing these points Q are determined as candidates for installation positions of the transducers 21.

In the examples shown in FIGS. 8A and 8B, specific points Q are determined to have positions at distances equal to one-half, one-third, and two-third of the distance between arbitrary two points P on the frame. To improve the accuracy of candidate selection, additional specific points Q may be determined to have their positions that divide the distance between arbitrary two points P into four or more- (e.g., to have positions at distances equal to one-fourth, three-fourth, etc. of the distance between the two points).

In a lower tone range, vibration similar to piston vibration takes place in the sound board 33. When vibrational excitation is input to a sound board portion, which corresponds to any of node lines appearing on the sound board 33 upon vibrational excitation, weak vibration alone occurs in the sound board 33. On the other hand, in a higher tone range, complicated vibrations occur in a point-weighing fashion. Even when the position to which an input for vibrational excitation is supplied is somewhat shifted from any of the candidates for transducer installation positions, there occurs no substantial reduction in vibration efficiency. The above indicates that it is preferable, in particular for transducers for lower tones, that each of transducer installation positions be strictly set to coincide with any of the candidates for installation positions.

To permit musical tones to be sounded over a broad frequency band, the provision of one or more transducers 21 is necessary that are disposed to avoid or bypass the mounting positions of screws 34 and specific positions between screws on the sound board 33 and the frame 31. More preferably, it is important to provide a plurality of transducers 21 that are disposed at locations where the node line density is less dense.

According to the present embodiment, the transducers 21 are disposed at locations other than the screw mounting positions and the specific points between the screws, as viewed in plan of the sound board 33. In particular, the transducers 21 are disposed at locations where node lines are less dense that are generated when the sound board 33 is caused to freely vibrate at respective natural frequencies, whereby efficient vibration of the sound board 33 can be realized, thus attaining natural sounds with satisfactory sound quality in a broad frequency band.

Moreover, the transducers 21A, 21B and the transducer 21C that differs in characteristics from the former two transducers are disposed at locations determined in accordance with their characteristics. In addition, driving signals for the transducers 21 are individually generated according to their characteristics and installation positions and in response to the performance operators 15 being operated, and the generated driving signals are output. The usage of these outputs for the individual transducers makes it possible to carry out delicate control of sound board vibration, resulting in production of natural sounds in a broad frequency band and an easy sound quality control.

Moreover, the sound board 33 is formed into a shape similar to that of a grand piano. Therefore, also in this respect, the sound board 33 can realize production of natural sounds close to those sounded by a grand piano. The sound board 33 is ideal in shape in reproducing piano sounds for the reason that, especially when lower tones are sounded by causing a plate-like member such as the sound board 33 to vibrate, a larger vibration area is required as compared to when higher tones are sounded.

In the present embodiment, the sound board 33 has its shape similar to that of a piano in order to perform more appropriate reproduction of piano sounds. From the viewpoint of simply permitting musical tones to be sounded, the sound board 33 may be formed into any shape, but preferably be formed into a shape suitable for the type of tones to be sounded. For example, for reproduction of violin tones, it is preferable that the sound board 33 be formed into a violin shape. In this case, ideal tone production can be expected.

In the generation of driving signals according to the present embodiment, the first and second performance signals are first generated (steps S109, S112, S114, and S115 in FIG. 5), and the generated performance signals are processed in the effect processing section 26 and the delay processing section 27. Subsequently, three driving signals to be output to the transducers 21A, 21B, and 21C are generated in the output distributing section (step S105 in FIG. 5). This is not essentially required. The output distributing function may be implemented at a stage preceding the effect processing section 26 and the delay processing section 27, and driving signals responsive to a key operation of the keyboard 17 and driving signals responsive to an operation of the pedal 18 may be generated individually for the transducers 21A, 21B, and 21C.

It should be noted that, in the present embodiment, the transducers 21 are attached to the upper face of the sound board 33, but may be attached to the lower face thereof. In addition, the transducers 21A and 21B may have different characteristics. The number of the transducers 21 may be one at the minimum in order to simply permit tones to be sounded without performing sound field localization control. From the viewpoint of attaining satisfactory sound quality, however, it is preferable that two or more transducers be used, and of course, four or more transducers may be used where appropriate.

What is claimed is:

1. An electronic keyboard musical instrument comprising:

a plurality of performance operators;

a sound board made of a vibratable member;

a plurality of spaced vibrating devices, all having different characteristics from one another, each drivable by a driving signal, mounted to the sound board at positions determined according to their characteristics to vibrate the sound board; and a signal generating and outputting device that generates and outputs driving signals in accordance with the characteristics and the mounting positions of the vibrating devices for driving at least one of said vibrating devices in response to at least any one of said performance operators being operated.

2. An electronic keyboard musical instrument according to claim 1, wherein:

said plurality of performance operators include a keyboard having a plurality of keys and at least one damper pedal, and said signal generating and outputting device includes a first performance signal generator that generates a first performance signal in response to a key operation of the keyboard, and a second performance signal generator that generates a second performance signal in response to an operation of the damper pedal.

3. An electronic keyboard musical instrument according to claim 2, wherein said signal generating and outputting device includes a first processing section in which the first performance signal is subjected to first processing, a second processing section in which the second performance signal is subjected to second processing, and an output distributing section that distributes outputs to said vibrating devices based on a mixture signal of the first performance signal having been subjected to the first processing and the second performance signal having been subjected to the second processing.

4. An electronic keyboard musical instrument according to claim 3, wherein the first performance signal is subjected to effect processing in said first processing section, the second performance signal is subjected to delay processing in said second processing section, said output distributing section distributes the outputs to said vibrating devices based on an addition signal of the first performance signal having been subjected to the effect processing and the second performance signal having been subjected to the delay processing.

5. An electronic keyboard musical instrument according to claim 2, wherein:

said signal generating and outputting device includes a first performance data storage that stores first performance data indicating musical tones sounded by an acoustic piano when a piano key thereof is operated without a piano damper pedal thereof being depressed, and a second performance data storage that stores second performance data indicating musical tones sounded by the acoustic piano when a piano key thereof is operated with the piano damper pedal thereof being depressed, said first performance signal generator generates the first performance signal with the first performance data, and said second performance signal generator generates the second performance signal with the second performance data.

6. An electronic keyboard musical instrument according to claim 2, further including at least one leg member, and a frame mounted to the leg member, wherein:

the damper pedal is mounted to the leg member, the sound board and the keyboard are supported by the frame, and the sound board is has a shape of a piano sound board.

7. An electronic keyboard musical instrument according to claim 6, wherein the frame is smaller in size than and similar in shape to the sound board.

8. An electronic keyboard musical instrument according to claim 6, wherein the sound board is fixed to the frame using a plurality of fixtures.

9. An electronic keyboard musical instrument according to claim 1, further including at least one leg member and a frame fixed to the leg member, wherein the sound board is fixed to the frame with a plurality of fixtures.

10. An electronic keyboard musical instrument according to claim 9, wherein said vibrating devices are mounted to the sound board at locations other than the fixtures and the frame.

11. An electronic keyboard musical instrument according to claim 10, wherein said vibrating devices are mounted to the sound board at locations other than positions that are at a distance equal to a quotient derived by dividing a distance between each pair of the fixtures by an integer number.

12. An electronic keyboard musical instrument according to claim 1, wherein said plurality of performance operators include a keyboard having a plurality of keys, said vibrating devices include a first vibrating device mounted to a lower tone side of the keys and serving to generate a lower tone, and a second vibrating device mounted to a higher tone side of the keys and serving to generate a higher tone.

13. An electronic keyboard musical instrument according to claim 1, wherein said vibrating devices are mounted to the sound board at locations where node lines produced are less dense when the sound board is vibrated at natural resonant frequencies thereof.

* * * * *